US011264149B2

(12) United States Patent
Chen et al.

(10) Patent No.: US 11,264,149 B2
(45) Date of Patent: Mar. 1, 2022

(54) TWIN AXIAL CABLE WITH DUAL EXTRUDED DIELECTRIC

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Joe-Fu Chen, Irvine, CA (US); Jie Zheng, Rowland-Heights, CA (US); An-Jen Yang, Irvine, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/086,770

(22) Filed: Nov. 2, 2020

(65) Prior Publication Data

US 2021/0134487 A1 May 6, 2021

Related U.S. Application Data

(60) Provisional application No. 62/929,822, filed on Nov. 2, 2019.

(51) Int. Cl.

| | |
|---|---|
| ***H01B 11/00*** | (2006.01) |
| ***H01B 7/02*** | (2006.01) |
| ***H01B 7/08*** | (2006.01) |
| ***H01B 13/06*** | (2006.01) |
| ***H01B 13/14*** | (2006.01) |

(52) U.S. Cl.

CPC ..... *H01B 11/002* (2013.01); *H01B 7/0208* (2013.01); *H01B 7/0838* (2013.01); *H01B 13/06* (2013.01)

(58) Field of Classification Search

CPC .. H01B 7/0216; H01B 7/0807; H01B 7/0838; H01B 11/002; H01B 11/04

See application file for complete search history.

(56) References Cited

U.S. PATENT DOCUMENTS

| | | | | |
|---|---|---|---|---|
| 5,142,100 A | | 8/1992 | Vaupotic | |
| 6,005,191 A | * | 12/1999 | Tzeng | H01B 11/10 174/102 R |
| 8,981,216 B2 | | 3/2015 | Grant et al. | |
| 9,123,452 B2 | | 9/2015 | Sugiyama et al. | |

(Continued)

*Primary Examiner* — Hoa C Nguyen
*Assistant Examiner* — Amol H Patel
(74) *Attorney, Agent, or Firm* — Ming Chieh Chang; Wei Te Chung

(57) ABSTRACT

A twin axial cable includes a pair of wires each with a core conductor; a first dielectric extruded around each of the core conductors, said pair of conductors with the first dielectrics being intimately side by side positioned with each other in a transverse direction; a second dielectric different form the first dielectric and extruded around the first dielectrics; a shielding layer enclosing the second dielectric; and a heat seal PET layer enclosing the shielding layer. A coupling ratio which is calculated by a value of an even mode characteristic impedance subtracted an odd mode characteristic impedance divided by a value of the even mode characteristic impedance pulsed the odd mode characteristic impedance is between 15% to 30%.

20 Claims, 9 Drawing Sheets

(56) References Cited

U.S. PATENT DOCUMENTS

| | | | | |
|---|---|---|---|---|
| 10,573,434 | B2 | 2/2020 | Kobayashi | |
| 2003/0150633 | A1* | 8/2003 | Hirakawa | H01B 11/1016 174/36 |
| 2006/0021772 | A1* | 2/2006 | Dellagala | H01B 11/002 174/27 |
| 2012/0186850 | A1* | 7/2012 | Sugiyama | H01B 11/1834 174/102 R |
| 2016/0036112 | A1 | 2/2016 | Sugiyama et al. | |
| 2018/0047479 | A1* | 2/2018 | Hansen | H01B 7/0216 |
| 2018/0158575 | A1* | 6/2018 | Visser | H01B 11/1813 |
| 2018/0268965 | A1 | 9/2018 | Dettmer et al. | |
| 2020/0185842 | A1* | 6/2020 | Lloyd | H01L 23/3672 |

* cited by examiner

TWIN AXIAL CABLE WITH DUAL EXTRUDED DIELECTRIC

BACKGROUND OF THE INVENTION

1. Field of the Invention

The present disclosure relates to a cable, in particular to a twin axial cable for use with data transmission faster than 56/112 Gbps.

2. Description of Related Art

Traditional twin axial cables for 10 Gbps and above data transmission typically have approximately 5% coupling. Dual extrusion is an existing method that enables increasing the coupling percentage of twin axial cables. However, this method cannot rely on off-the-shelf in-line electronic process controls developed for single insulated conductors. U.S. Pat. Nos. 5,142,100, 8,981,216, and 9,123,452 disclose some related designs. FIG. 9 shows a traditional twin axial cable having sequentially a pair of conductors 31 enclosed within a dielectric layer 32 having a stadium cross-section thereof, a Cu alloy layer 33 enclosing the dielectric layer 32, another metallic layer 34 enclosing the Cu alloy layer 33, and an insulative jacket 35 enclosing the metallic layer 34.

An improved twin axial cable is desired.

SUMMARY OF THE INVENTION

Accordingly, an object of the present disclosure is to provide a twin axial cable with 15%-30% signal pair coupling and the corresponding reduced signal power loss. Another object of the invention is to provide the aforementioned cable made by the dual extrusion method with some improvements thereof.

To achieve the above object, a twin axial cable includes a pair of wires each with a core conductor; a first dielectric extruded around each of the core conductors, said pair of conductors with the first dielectrics being intimately side by side positioned with each other in a transverse direction; a second dielectric different form the first dielectric, extruded around both of the pair of the first dielectrics; a shielding layer enclosing the second dielectric; and a heat seal PET layer enclosing the shielding layer. A coupling ratio which is calculated by a value of an even mode characteristic impedance subtracted an odd mode characteristic impedance divided by a value of the even mode characteristic impedance pulsed the odd mode characteristic impedance is between 15% to 30%.

Alternately, an outwardly facing Cu (Copper) foil encloses the second dielectric layer, an inwardly facing Al foil enclosing the Cu foil, and a heat seal PET layer encloses the Al foil without involvement with any bare drain wires between the Al foil and the heat seal PET layer.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
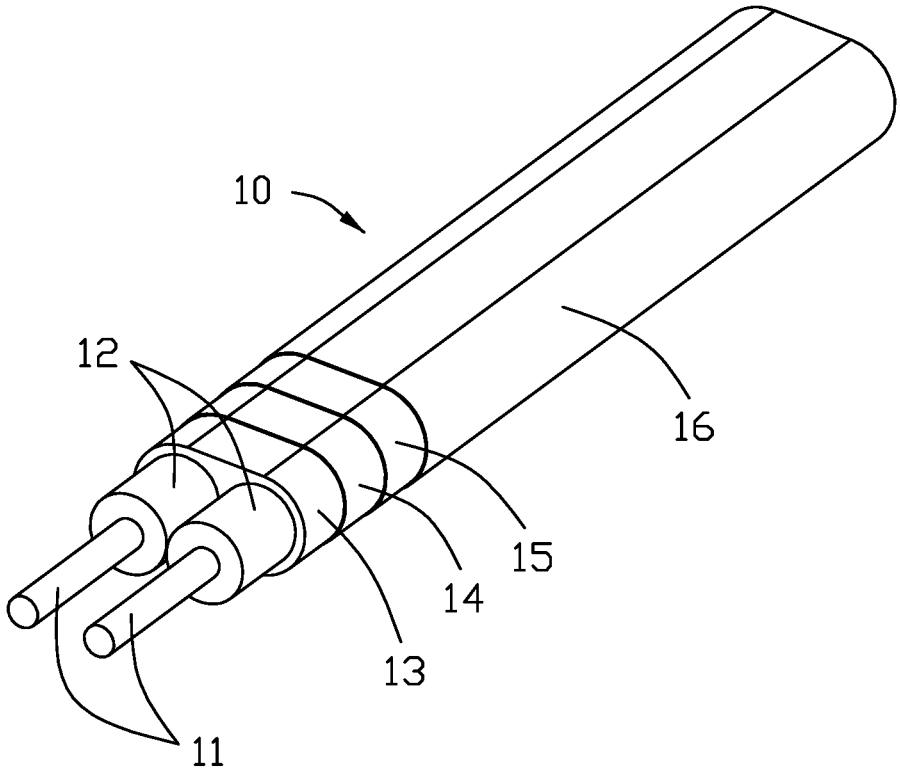
FIG. 1 is a perspective view of the twin axial cable according to a first embodiment of the invention.
Figure 2:
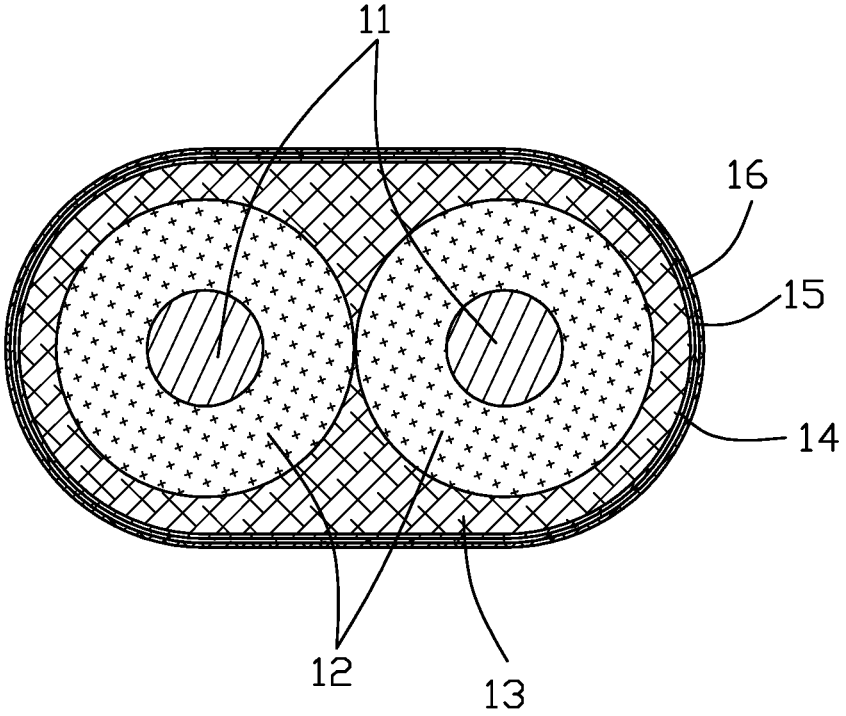
FIG. 2 is a cross-sectional view of the twin axial cable of FIG. 1.
Figure 3:
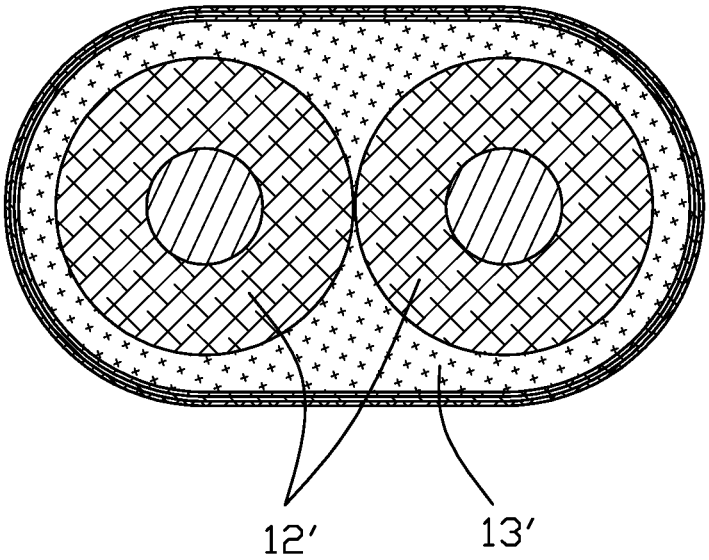
FIG. 3 is another embodiment cross-sectional view of the twin axial cable of FIG. 1.

Referring to FIGS. 1-3, a first embodiment twin axial or differential pair cable 10 includes a pair of wires, which are not twisted with each other, each with a core conductor 11 which may have sliver plated enclosed in a first dielectric layer or first dielectric 12 having a round cross-sectional contour. The pair of wires are intimately side by side positioned with each other in a transverse direction and commonly enclosed within a second dielectric layer or second dielectric 13 having a stadium like cross-sectional contour with no air gap between the second dielectric 13 and the first dielectrics 12, wherein a thickness of the second dielectric layer 13 on two opposite lateral sides of the pair of wires is around two fifths of a thickness of the first dielectric layer 12. There is no drain wire located in twin axial cable. A thickness of the first dielectric layer 12 is around three fourths of a diameter of the core conductor 11. The first dielectrics 12 are extruded around each of the core conductors 11, said pair of conductors 11 with the first dielectrics 12 being intimately side by side positioned with each other in a transverse direction. The second dielectric 13 different form the first dielectric is extruded around both of the pair of the first dielectrics 12. Therefore, there is no air between the pair of the first dielectrics 12. Referring to FIG. 2, the first dielectric 12 is formed by solid insulation, and the second dielectric 13 is formed by foamed insulation. Referring to FIG. 3, the first dielectric 12' is formed by foamed insulation, and the second dielectric 13' is formed by solid insulation. In other embodiment, the first dielectric and the second dielectric are formed by foamed insulations at different foaming ratios. A coupling ratio which is calculated by a value of an even mode characteristic impedance subtracted an odd mode characteristic impedance divided by a value of the even mode characteristic impedance pulsed the odd mode characteristic impedance is between 15% to 30%. A transmitting speed of the twin axial cable is 112 Gbps.

In this embodiment, the twin axial cable 10 comprises a shielding layer enclosing the second dielectric 13, and a heat seal PET (Polyethylene Terephthalate) layer 16 enclosing the shielding layer. The shielding layer comprises an outwardly facing Cu (Copper) foil 14 enclosing the second dielectric layer 13, an inwardly facing Al (Aluminum) foil 15 enclosing the Cu foil 14. The heat seal PET layer 16 encloses the Al foil 15. The Al foil 15 is longitudinally or spirally wrapped, and the Cu foil 14 is longitudinally or spirally wrapped.

Figure 4:
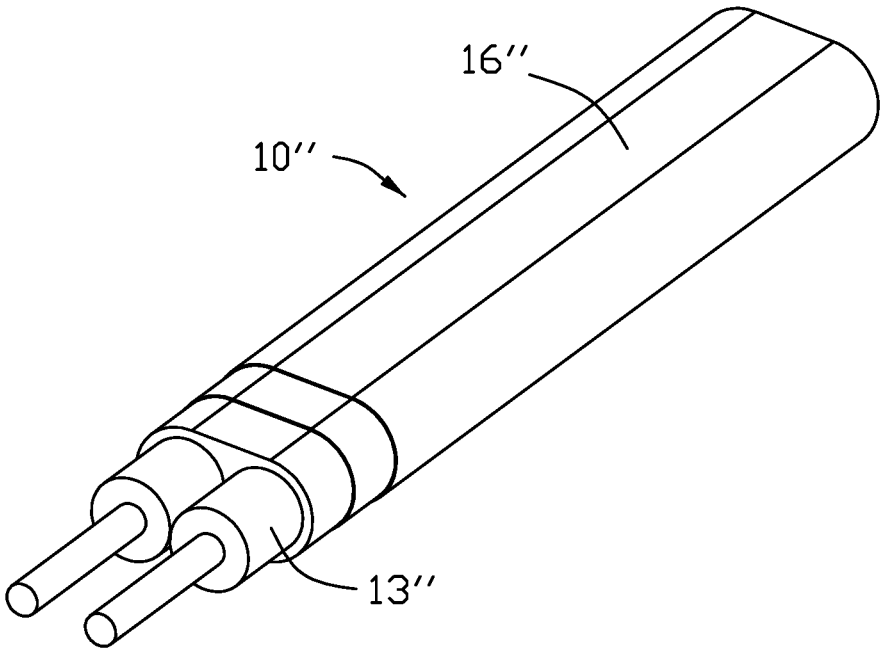
FIG. 4 shows a perspective view of the twin axial cable according to another embodiment of the invention.
Figure 5:
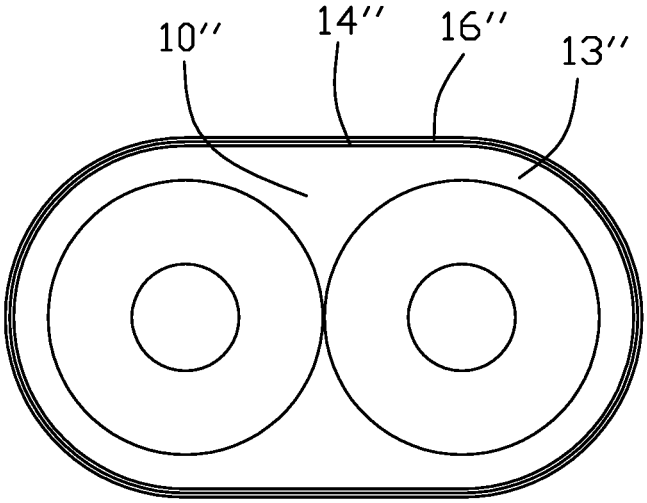
FIG. 5 is a cross-sectional view of the twin axial cable of FIG. 4.

Referring to FIGS. 4 and 5 show another embodiment wherein a twin axial or differential pair cable 10" comprises a shielding layer enclosing the second dielectric 13" and a heat seal PET layer 16" enclosing the shielding layer. In this embodiment, the shielding layer only comprises a Cu foil 14". There is no drain wire located in twin axial cable 10". The Cu foil 14" is longitudinally or spirally wrapped.

Figure 6:
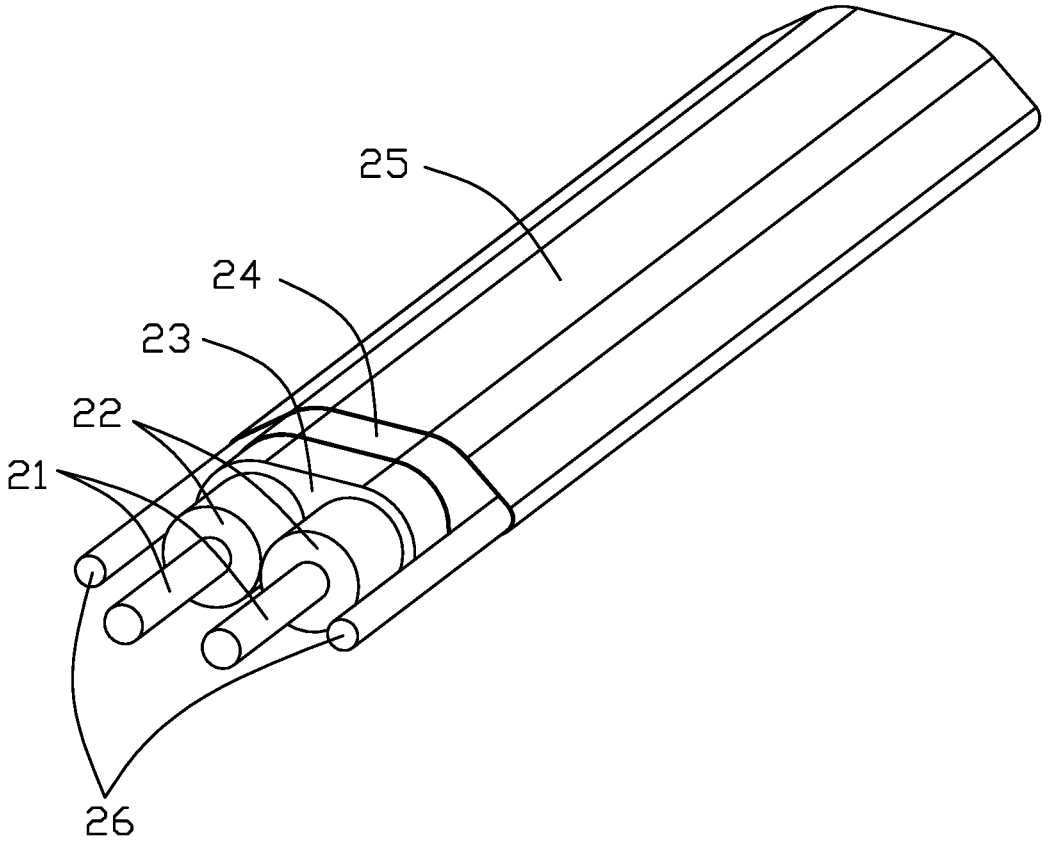
FIG. 6 shows a perspective view of the twin axial cable according to another embodiment of the invention.
Figure 7:
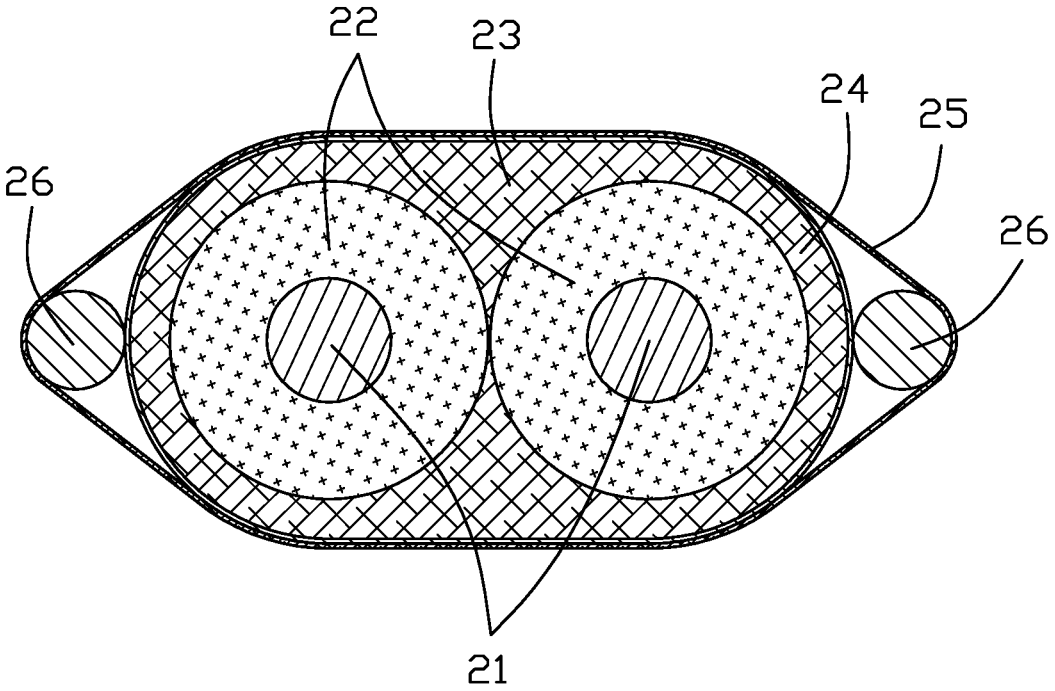
FIG. 7 is a cross-sectional view of the twin axial cable of FIG. 6.
Figure 8:
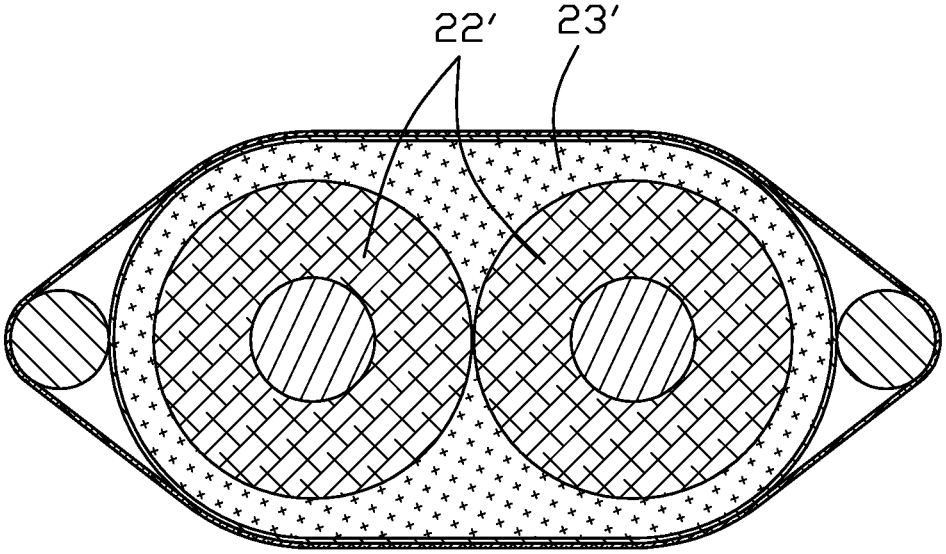
FIG. 8 is another embodiment cross-sectional view of the twin axial cable of FIG. 6.
Figure 9:
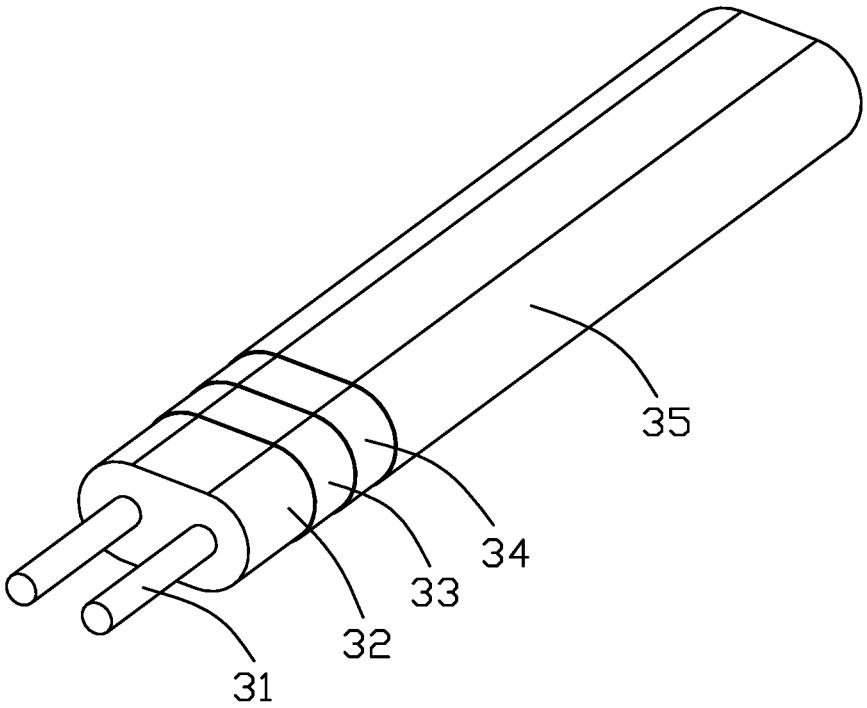
FIG. 9 is a perspective view of the twin axial cable of one traditional design.

FIGS. 6-8 show another embodiment wherein each core conductor 21 is enclosed within a first dielectric layer 22 having a round cross-section, and both wires are commonly enclosed within a second dielectric layer 23 having a stadium cross-section, with no air gap between the second dielectric layer 23 and the first dielectric layers 22. An outward facing Al foil 24 encloses the second dielectric layer 23, and a heat seal PET layer 25 encloses the Al foil 24 with a pair of bare drain wires 26 located by two sides of the pair of wires or one bare drain 26 wire located by one of two sides of the pair of wires and tightly sandwiched between the Al foil 24 and the heat seal PET layer 25 in the transverse direction. Referring to FIG. 7, the first dielectric 22 is formed by solid insulation, and the second dielectric 23 is formed by foamed insulation. Referring to FIG. 8, the first dielectric 22' is formed by foamed insulation, and the second dielectric 23' is formed by solid insulation. In other embodiment, the first dielectric and the second dielectric are formed by foamed insulations at different foaming ratios.

Understandably, the first dielectric layer can be of foamed insulation and the second dielectric layer can be of solid insulation, and vice versa. In all embodiments, there is no space or air is formed between the first dielectric layer and the second dielectric layer or between the second dielectric layer and the metallic shielding layer intimately surrounding the second dielectric layer.

What is claimed is:

1. A twin axial cable comprising:

a pair of wires each with a core conductor;

a first dielectric extruded around each of the core conductors, said pair of conductors with the first dielectrics being intimately side by side positioned with each other in a transverse direction;

a second dielectric being different from the first dielectric and extruded around the first dielectrics with no air gap therebetween;

a shielding layer enclosing the second dielectric; and a heat seal PET layer enclosing the shielding layer;

wherein a coupling ratio which is calculated by a value of an even mode characteristic impedance subtracted an odd mode characteristic impedance divided by a value of the even mode characteristic impedance plus the odd mode characteristic impedance is between 15% to 30%.

2. The twin axial cable as claimed in claim 1, wherein the first dielectric has a round cross-section.

3. The twin axial cable as claimed in claim 1, wherein the second dielectric has a stadium cross-section.

4. The twin axial cable as claimed in claim 1, wherein the shielding layer is Cu foil enclosing the second dielectric, and there is no drain wire located in twin axial cable.

5. The twin axial cable as claimed in claim 4, wherein the Cu foil is longitudinally or spirally wrapped.

6. The twin axial cable as claimed in claim 1, wherein the shielding layer comprises an outer Al foil and an inner Cu foil.

7. The twin axial cable as claimed in claim 6, wherein the Al foil is longitudinally or spirally wrapped, and the Cu foil is longitudinally or spirally wrapped.

8. The twin axial cable as claimed in claim 1, wherein one bare drain wire located by one of two sides of the pair of wires or a pair of bare drain wires located by two sides of the pair of wires and tightly sandwiched between the shielding layer and the heat seal PET layer in the transverse direction.

9. The twin axial cable as claimed in claim 1, wherein the first dielectric is formed by solid insulation, and the second dielectric is formed by foamed insulation.

10. The twin axial cable as claimed in claim 1, wherein the first dielectric is formed by foamed insulation, and the second dielectric is formed by solid insulation.

11. The twin axial cable as claimed in claim 1, wherein the first dielectric and the second dielectric are formed by foamed insulations at different foaming ratios.

12. The twin axial cable as claimed in claim 1, wherein a thickness of the first dielectric is around three-fourths of a diameter of the core conductor.

13. The twin axial cable as claimed in claim 1, wherein a thickness of the second dielectric on two opposite lateral sides of the pair of wires is around two fifths of a thickness of the first dielectric layer.

14. The twin axial cable as claimed in claim 1, wherein a transmitting speed of the twin axial cable supports 112 Gbps.

15. A twin axial cable comprising:

a pair of wires side by side arranged with each other in a transverse direction, each of the wires having a core conductor;

a first dielectric extruded around each of the core conductors, said pair of conductors with the first dielectrics being intimately side by side positioned with each other in a transverse direction;

a second dielectric being different from the first dielectric and extruded around the first dielectrics with no air gap therebetween;

a shielding layer enclosing the second dielectric; and a heat seal PET layer enclosing the shielding layer; wherein one of the first dielectric and the second dielectric is solid insulation while the other of the first dielectric and the second dielectric is foamed insulation;

wherein a coupling ratio, which is calculated by a value of an even mode characteristic impedance minus an odd mode characteristic impedance and further divided by another value of the even mode characteristic impedance plus the odd mode characteristic impedance, is in a range of 10% to 35%.

16. The twin axial cable as claimed in claim 15, wherein the first dielectric has a round cross-section.

17. The twin axial cable as claimed in claim 15, wherein the coupling ratio is in a range of 15% to 35%.

18. The twin axial cable as claimed in claim 15, wherein the second dielectric has a stadium cross-section having a long dimension along the transverse direction and a short dimension in a vertical direction perpendicular to the transverse direction, and the short dimension is larger than a diameter of the first dielectric in the vertical direction.

19. The twin axial cable as claimed in claim 18, wherein a ratio among a diameter of the core conductor, the diameter of the first dielectric and the short dimension of the second dielectric, is around 3:8:10.

20. The twin axial cable as claimed in claim 15, wherein the coupling ratio is in a range of 10% to 30%.

* * * * *